US011167291B2

(12) United States Patent
Jang

(10) Patent No.: US 11,167,291 B2
(45) Date of Patent: Nov. 9, 2021

(54) HYBRID PARTITION WITH FUNCTION OF REMOVING FINE DUST

(71) Applicant: OFFICE ANGUNSA CO., LTD., Seoul (KR)

(72) Inventor: Hyun Su Jang, Seoul (KR)

(73) Assignee: OFFICE ANGUNSA CO., LTD., Seoul (KR)

( * ) Notice: Subject to any disclaimer, the term of this patent is extended or adjusted under 35 U.S.C. 154(b) by 0 days.

(21) Appl. No.: 17/157,598

(22) Filed: Jan. 25, 2021

(65) Prior Publication Data

US 2021/0268516 A1 Sep. 2, 2021

(30) Foreign Application Priority Data

Feb. 27, 2020 (KR) ..... 10-2020-0024075

(51) Int. Cl.

| | |
|---|---|
| ***B03C 3/08*** | (2006.01) |
| ***B03C 3/38*** | (2006.01) |
| ***B03C 3/60*** | (2006.01) |
| ***B03C 3/66*** | (2006.01) |
| ***B03C 3/82*** | (2006.01) |
| ***B03C 3/88*** | (2006.01) |
| ***E04B 1/99*** | (2006.01) |
| ***E04B 2/72*** | (2006.01) |

(52) U.S. Cl.

CPC ..... *B03C 3/08* (2013.01); *B03C 3/38* (2013.01); *B03C 3/60* (2013.01); *B03C 3/66* (2013.01); *B03C 3/82* (2013.01); *B03C 3/88* (2013.01); *E04B 1/99* (2013.01); *E04B 2/72* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 3,747,299 | A * | 7/1973 | Chiang | B03C 3/12 | 95/79 |
| 3,751,715 | A * | 8/1973 | Edwards | H01T 23/00 | 361/230 |
| 3,896,347 | A * | 7/1975 | Gelfand | B03C 3/70 | 96/28 |
| RE41,812 | E * | 10/2010 | Taylor | B03C 3/08 | 96/89 |
| 2005/0051028 | A1* | 3/2005 | Botvinnik | B03C 3/60 | 96/88 |

(Continued)

FOREIGN PATENT DOCUMENTS

| | | | | |
|---|---|---|---|---|
| JP | 51148872 | A * | 12/1976 | B03C 3/743 |
| JP | 2010069360 | A | 4/2010 | |
| KR | 200282454 | Y1 | 7/2002 | |

(Continued)

*Primary Examiner* — Christopher P Jones
*Assistant Examiner* — Sonji Turner
(74) *Attorney, Agent, or Firm* — Rabin & Berdo, P.C.

(57) ABSTRACT

An object of the present disclosure is to provide a partition with a function of dividing a space in a room and removing fine dust with low energy without requiring a separate installation space, and more particularly, to a hybrid partition with a function of removing fine dust while dividing a space, the hybrid partition including: a partition frame; outer finishing plates; dust attachment plates; an air introduction part; a dust collecting part; a dust removing part; and an air discharge part.

6 Claims, 3 Drawing Sheets

(56) References Cited

U.S. PATENT DOCUMENTS

| | | | | |
|---|---|---|---|---|
| 2005/0199125 | A1* | 9/2005 | Taylor | B01J 19/08 96/39 |
| 2014/0273184 | A1* | 9/2014 | Gordon | G01N 1/40 435/287.2 |

FOREIGN PATENT DOCUMENTS

| | | | | | |
|---|---|---|---|---|---|
| KR | 1020100078737 | A | | 7/2010 | |
| KR | 20120040450 | | * | 10/2010 | E04B 2/72 |
| KR | 101664011 | B1 | | 10/2016 | |
| KR | 1020180038435 | A | | 4/2018 | |
| KR | 102069767 | B1 | | 1/2020 | |

* cited by examiner

HYBRID PARTITION WITH FUNCTION OF REMOVING FINE DUST

CROSS-REFERENCE TO RELATED APPLICATIONS

This application claims the priority of Korean Patent Application No. 10-2020-0024075 filed on Feb. 27, 2020, in the Korean Intellectual Property Office, the disclosure of which is incorporated herein by reference.

BACKGROUND

Field

The present disclosure relates to a hybrid partition with a function of removing fine dust, and more particularly, to a partition having a structure capable of removing fine dust and noise while separating an indoor space from an outdoor space.

Description of the Related Art

In general, partitions are used as means for dividing spaces into compartments to block lines of sight or noise from other compartments.

Recently, fine dust is considered as a serious social problem.

The fine dust contains substances suspended in the atmosphere and having various complex components. The fine dust is produced from exhaust gas generated from vehicles or ships, and soot and smoke generated from factories or thermal power stations. The fine dust is also produced inside general rooms where people live.

Exposure to the fine dust over a long period of time may cause respiratory and cardiovascular diseases. In particular, the fine dust remaining on the floor in the room or in the gaps in the furniture in the room may contaminate the room again. Even a small amount of fine dust in the room has a great effect on the human body because people live in the room for a long period of time.

Meanwhile, Patent Document 1 discloses a partition having a sound absorbing means, in which sound insulators are stacked and coupled at two front and rear sides of a central panel, support members are fitted and coupled to form air layers, sound absorbers and perforated plates are stacked at front and rear sides of the sound insulators to form a panel body, and a frame is coupled and fixed at upper and lower sides of the panel body to form a partition main body in order to divide a space and absorb sound. However, the partition is used only as a means for dividing spaces into compartments to block lines of sight or noise from other compartments.

In addition, an air cleaner equipped with a filter is often used to remove fine dust in the room. As disclosed in Patent Document 2, the air cleaner removes fine dust by placing the filter in a forced air flow created mainly by a device such as a fan.

Further, as disclosed in Patent Document 2, an ion generating unit is provided to facilitate collection of fine dust. The ion generating unit emits positive ions and negative ions into the air to allow the fine dust in the air to aggregate, thereby facilitating filtration.

Such a fine dust removing device in the related art requires changes of the filters, a large amount of energy, and a separate installation space, which incurs a large amount of costs to remove the fine dust.

DOCUMENTS OF RELATED ART

Patent Documents (Patent Document 1) Korean Patent No. 20-0282454 (Jul. 19, 2002)

(Patent Document 2) Korean Patent No. 10-2069767 (Jan. 23, 2020)

SUMMARY

An object to be achieved by the present disclosure is to provide a partition that divides a space in a room and removes fine dust with low energy without using a separate installation space and a precise filter such as a HEPA filter.

Another object to be achieved by the present disclosure is to provide a partition that removes fine dust by allowing air to circulate only by a stack effect without a forced ventilation means such as a fan.

Still another object to be achieved by the present disclosure is to provide a partition in which noise is perfectly absorbed by a sound absorber while being continuously reflected and diffracted in the partition without damaging an aesthetic appearance of the partition.

According to an aspect of the present disclosure, a hybrid partition with a function of removing fine dust while dividing a space includes: a partition frame configured to support the partition on a floor; outer finishing plates coupled to be opposite to each other and spaced apart from the frame at an interval; dust attachment plates installed inside the outer finishing plates and configured to define an air flow space; an air introduction part provided at a lower side of the partition and configured to communicate with the air flow space; a dust collecting part provided in the air flow space and configured to collect the bound fine dust; a dust removing part configured to remove the collected fine dust; and an air discharge part provided at an upper side of the partition, formed to communicate with the air flow space at the lower side of the partition, and configured to discharge air from which the fine dust is removed, in which the air discharge part is positioned at a position higher than the air introduction part, such that the air containing the fine dust and introduced from the air introduction part is discharged through the air discharge part by a stack effect.

In addition, the dust attachment plates may include a negative-electrode dust attachment plate and a positive-electrode dust attachment plate which are made of metal materials having different potential differences and electrically bond with charged fine dust in the air so that the fine dust is attached to the negative-electrode dust attachment plate and the positive-electrode dust attachment plate, the negative-electrode dust attachment plate may be made of copper, and the positive-electrode dust attachment plate may be made of one of iron, aluminum, and zinc having a different potential difference from copper.

In addition, the negative-electrode dust attachment plate and the positive-electrode dust attachment plate may be connected to each other with a circuit, and the circuit may include a direct-current power supply device such as a battery in order to increase the potential difference.

In addition, the hybrid partition may further include an ion generating device provided in the air flow space and configured to emit positive ions and negative ions into the air flow space so that fine dust particles are charged by the emitted ions, the potential difference between the dust attachment plates and the fine dust particles is increased, and sizes of the fine dust particles are maximized as the fine dust particles bond with one another, such that efficiency in removing the fine dust is improved.

In addition, the dust attachment plate may be provided with anti-flow protrusions, the anti-flow protrusion may be formed in a direction perpendicular to a direction in which air flows in the air flow space, and the anti-flow protrusion may protrude inward toward the air flow space to hinder a flow of dust on a surface of the dust attachment plate to make it easy to attach the fine dust.

In addition, a sound absorber may be provided between the outer finishing plate and the dust attachment plate, and inner sound absorbing holes may be provided, at predetermined intervals, in the dust attachment plate, such that noise introduced into the air flow space is perfectly absorbed by the sound absorber while being continuously reflected and diffracted in the outer finishing plate.

In addition, outer sound absorbing holes may be provided, at predetermined intervals, in the outer finishing plate 30 so that noise in a room is eliminated by being absorbed by the inside of the outer finishing plate through the outer sound absorbing holes.

The present disclosure having the above-mentioned characteristics provides the partition that may divide a space in the room without requiring a separate space in which a fine dust removing device such as an air cleaner or the like is installed. The present disclosure also provides the partition that may remove fine dust with low energy without using a precise filter such as a HEPA filter.

The present disclosure also provides a partition that removes fine dust by allowing air to circulate only by a stack effect without a forced ventilation means such as a fan.

Further, noise is perfectly absorbed by the inside of the outer finishing plate through the inner sound absorbing holes while being continuously reflected and diffracted in the partition, and as a result, it is possible to remove noise generated in the corresponding compartment without damaging an aesthetic appearance of the partition.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Hereinafter, an exemplary embodiment of the present disclosure will be described in detail with reference to the accompanying drawings.

Figure 1:
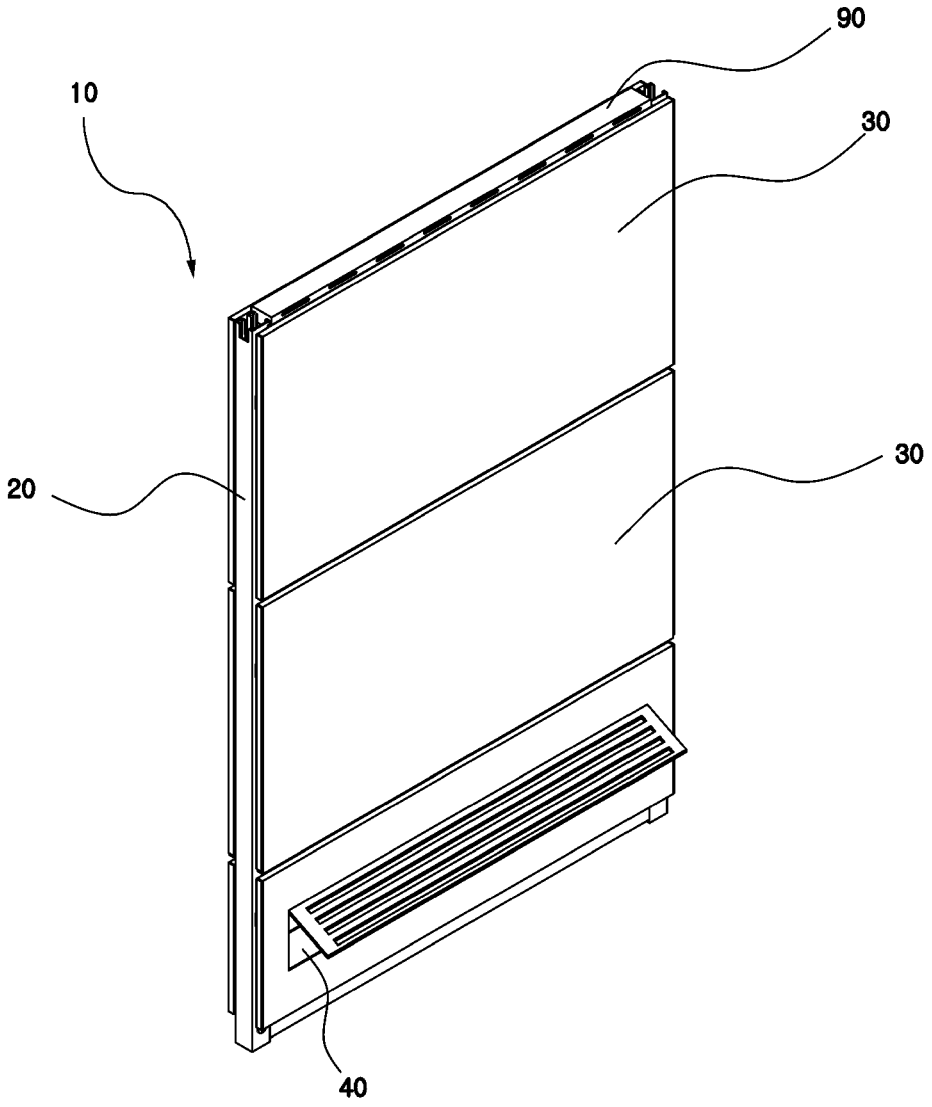
FIG. 1 is a perspective view illustrating a structure in which a sound-absorbing/dust-removing plate is attached to a frame of a hybrid partition according to an exemplary embodiment of the present disclosure.
Figure 2:
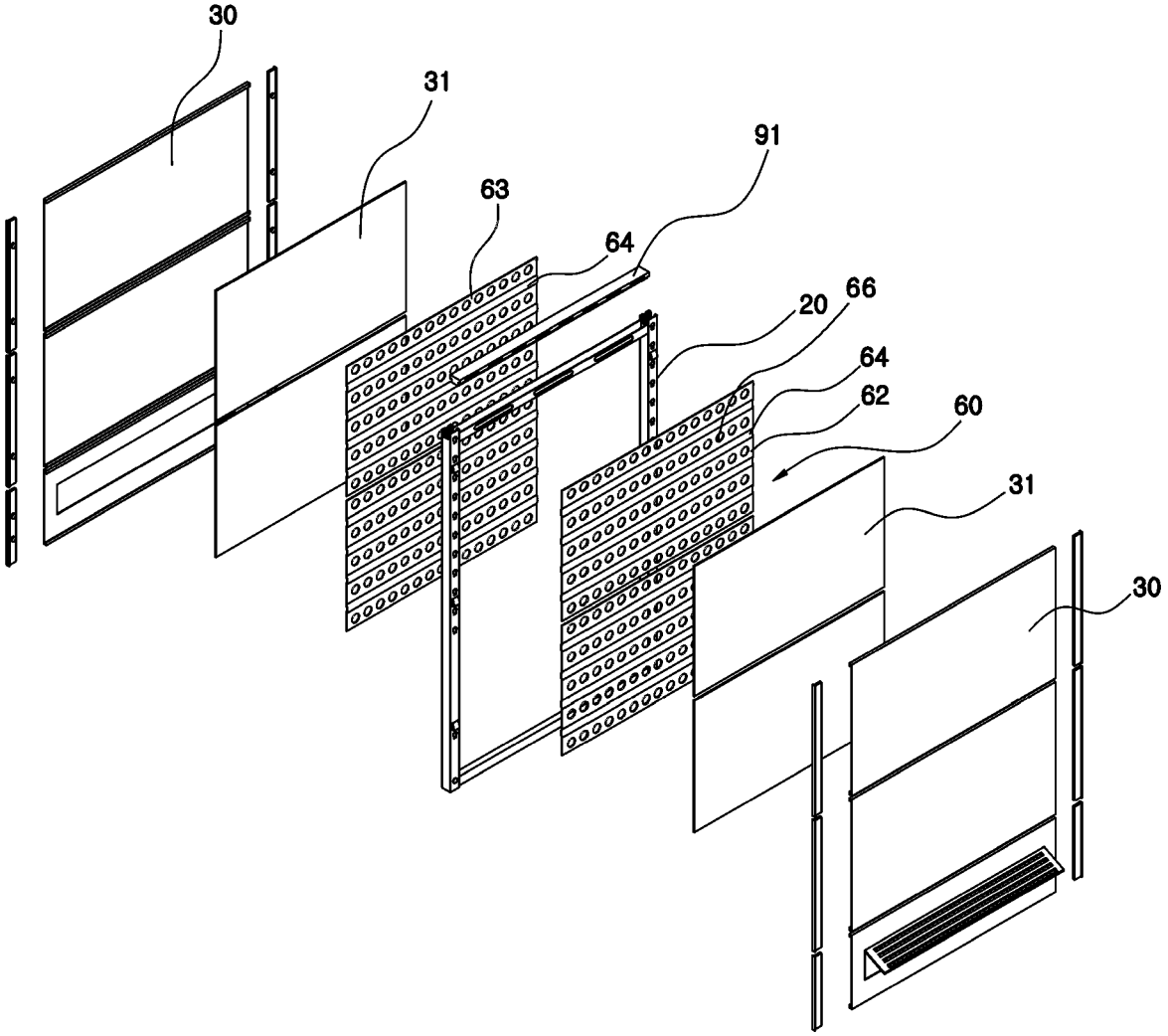
FIG. 2 is a configuration view illustrating a structure of the sound-absorbing/dust-removing plate of the hybrid partition according to the exemplary embodiment of the present disclosure.
Figure 3:
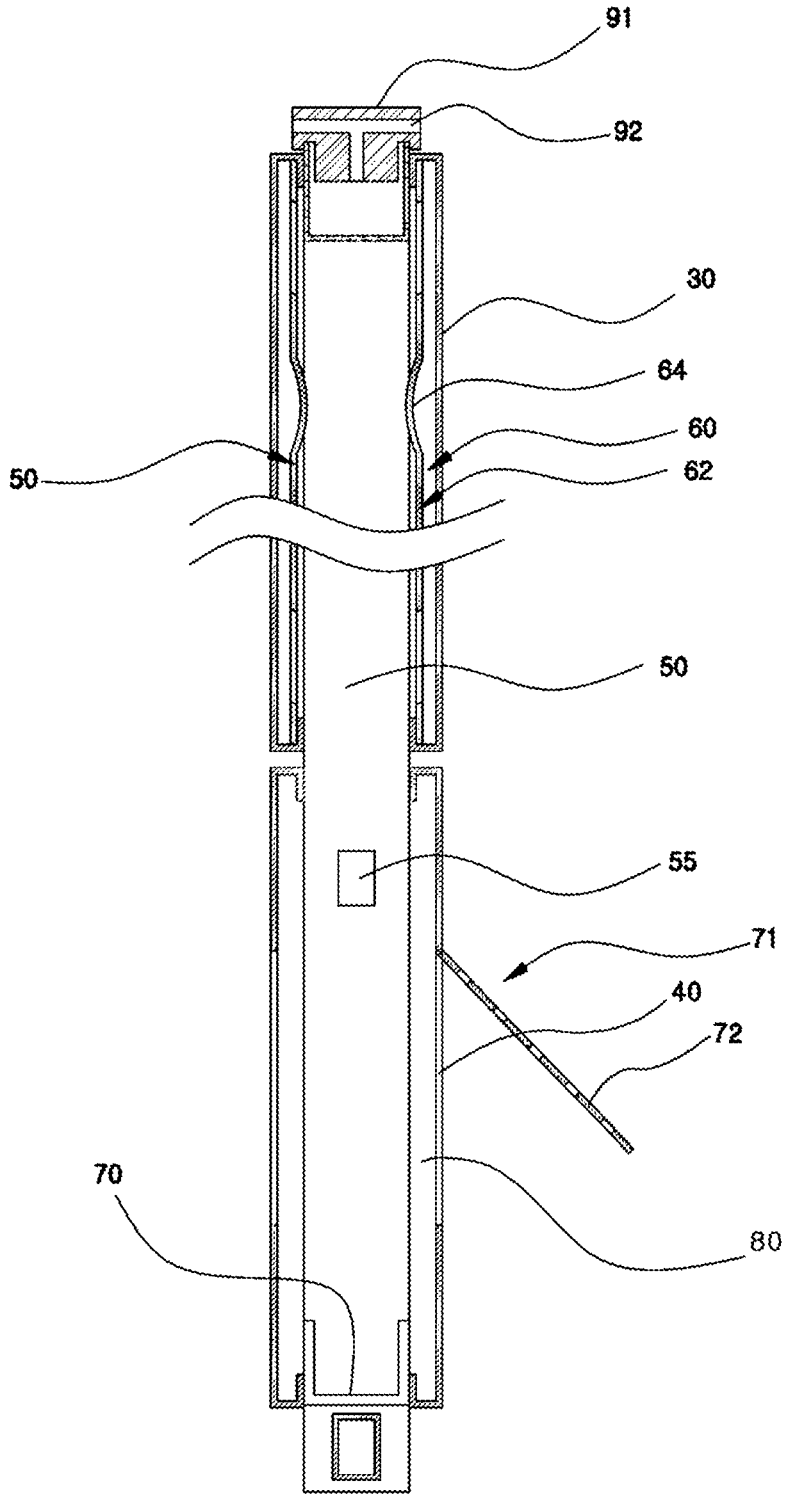
FIG. 3 is a cross-sectional view illustrating a state in which the hybrid partition according to the exemplary embodiment of the present disclosure is installed.

FIGS. 1, 2, and 3 are a perspective view, a configuration view, and a cross-sectional view according to the exemplary embodiment of the present disclosure. A hybrid partition 10 with a function of removing fine dust while dividing a space according to the exemplary embodiment of the present disclosure includes a partition frame 20 configured to support the partition on a floor, outer finishing plates 30 coupled to be opposite to each other and spaced apart from the frame 20 at an interval, dust attachment plates 60 installed inside the outer finishing plates 30 and configured to define an air flow space 50, an air introduction part 40 provided at a lower side of the partition and configured to communicate with the air flow space 50, a dust collecting part 70 provided in the air flow space 50 and configured to collect the bound fine dust, a dust removing part 80 configured to remove the collected fine dust, and an air discharge part 90 provided at an upper side of the partition, formed to communicate with the air flow space 50 at the lower side of the partition, and configured to discharge air from which the fine dust is removed.

The dust attachment plates 60 include a negative-electrode dust attachment plate 62 and a positive-electrode dust attachment plate 63 which are made of metal materials having different potential differences and electrically bond with charged fine dust in the air so that the fine dust is attached to the negative-electrode dust attachment plate 62 and the positive-electrode dust attachment plate 63.

In particular, the negative-electrode dust attachment plate 62 is made of copper, and the positive-electrode dust attachment plate 63 is made of one of iron, aluminum, and zinc having a different potential difference from copper, such that the negative-electrode dust attachment plate 62 and the positive-electrode dust attachment plate 63 are connected to form a circuit.

In addition, a direct-current power supply device, such as a battery, may be connected to the circuit in order to increase the potential difference between the negative-electrode dust attachment plate 62 and the positive-electrode dust attachment plate 63. In this case, a negative electrode of the direct-current power supply device may be connected to the negative-electrode dust attachment plate, a positive electrode of the direct-current power supply device may be connected to the positive-electrode dust attachment plate, and the negative-electrode dust attachment plate may be grounded for safety.

In addition, an ion generating device 55 is further provided in the air flow space 50 and emits positive ions and negative ions into the air flow space so that fine dust particles are charged by the emitted ions, the potential difference between the dust attachment plates and the fine dust particles is increased, and sizes of the fine dust particles are maximized as the fine dust particles bond with one another, such that efficiency in removing fine dust is improved. The ion generating device may generate ions by plasma discharge.

In addition, the dust attachment plate 60 is provided with anti-flow protrusions 64. The anti-flow protrusion 64 is formed in a direction perpendicular to a direction in which air flows in the air flow space. The anti-flow protrusion 64 protrudes inward toward the air flow space to hinder a flow of dust on a surface of the dust attachment plate 60, thereby making it easy to attach the fine dust to the dust attachment plate 60.

Meanwhile, the dust attached to the dust attachment plate 60 aggregates after a predetermined period of time and thus increases in size and weight, such that the dust is separated from the dust attachment plate 60 and dropped downward. As a result, the harmful substances such as fine dust are collected in the fine dust collecting part 70. The fine dust collecting part 70 may be positioned at a position lower than the air introduction part 40 so that dynamic air less affects the fine dust.

In addition, the dust removing part 80 is provided at the lower side to remove the separated fine dust with a vacuum cleaner or the like when a predetermined amount of fine dust is collected. The dust removing part 80 may be formed as a hole which is opened or closed by an opening plate hingedly coupled to the partition frame 20. In addition, the opening plate 71 may be covered by a grill 72 or the like to implement an aesthetic appearance, and the opening plate 71 may communicate with the air introduction part 40.

In addition, the air discharge part 90 may be provided with an upper finishing part 91 that covers the air flow space 50, and the upper finishing part 91 may be formed with a discharge passageway 92 through which air may be discharged.

In addition, a sound absorber 31 made of a non-woven fabric or the like may be provided between the outer finishing plate 30 and the dust attachment plate 60, and inner sound absorbing holes 66 are provided, at predetermined intervals, in the dust attachment plate 60, such that noise introduced into the air flow space 50 may be perfectly absorbed by the sound absorber 31 while being continuously reflected and diffracted in the outer finishing plate 30.

In addition, like the inner sound absorbing holes 66, outer sound absorbing holes may also be provided, at predetermined intervals, in the outer finishing plate 30 so that noise in the room may be eliminated by being absorbed by the inside of the outer finishing plate 30 through the outer sound absorbing holes. In this case, in order to prevent air in the air flow space from passing through the sound absorber and hindering the stack effect, only the outer sound absorbing holes may be provided without the inner sound absorbing hole 66, and the outer portion of the outer finishing plate 30 is covered by woven fabric or the like so that the outer sound absorbing holes are not visible from the outside.

An operation of the partition according to the present disclosure will be described below.

In general, the fine dust mainly includes primary solid fine dust discharged directly from factories, construction sites, vehicles, and the like, and secondary fine dust generated by a chemical reaction of gaseous air pollutants in the air. The fine dust exists in the form of nitrate ($NO_3-$), ammonium ($NH_4+$), sulfate ($SO_4^2-$), carbon ions, metal ions and has polarities with positive electric charges (+) or negative electric charges (−).

An electric field formed by adjacent metal plates having different potential differences captures fine dust in the ion states. For example, when a copper plate and an aluminum plate are disposed adjacent to each other, electric potential of the copper plate to a hydrogen electrode is +0.338 V, and electric potential of the aluminum plate to the hydrogen electrode is 1.662 V, such that the copper plate has properties of a negative electrode, and the aluminum plate has properties of a positive electrode. An electric field, which is a space where electric force is exerted, is formed between the metal electrode plates, and the intensity of the electric field increases when direct current is applied.

Meanwhile, in the exemplary embodiment of the present disclosure, the air discharge part 90 is positioned at a position higher than the air introduction part 40, such that the air containing fine dust and introduced from the air introduction part 40 is moved in the air flow space 50 between the dust attachment plates by the stack effect and then discharged through the air discharge part 90.

When the fine dust having the polarities with the positive electric charges (+) or the negative electric charges (−) in the electric field passes at a very low speed by the stack effect made by a difference in height of the partition, the repulsive force is applied when the electrode and the fine dust particle have the same type of charges, and the attractive force is applied when the electrode and the fine dust particle have different types of charges. As a result, when the fine dust is comparatively light, the fine dust is attracted to a charged body by electric force, such that the fine dust having the polarity is attached to the dust attachment plate which is a metal electrode plate having the polarity opposite to the polarity of the fine dust.

The plasma-discharge type ion generating device disposed in the vicinity of the air introduction part 40 emits the positive ions and the negative ions into the air flow space by plasma discharge, fine dust particles are charged by the discharged ions, the potential difference between the dust attachment plate and the fine dust particle is increased, and sizes of the fine dust particles are maximized as the fine dust particles bond with one another, such that efficiency in removing the fine dust is improved.

The movement of the attached dust is restricted by attachment force when the attachment force is high. The movement of the attached dust is restricted by the protrusions formed on the dust attachment plate when the attachment force is low. Therefore, the sizes of the attached dust are gradually increased over time, and when the size and the weight of the dust become a predetermined level or higher, the dust is separated from the dust attachment plate and accumulated on the lower side.

In order to prevent recirculation of the fine dust, at predetermined time intervals, the upper finishing part at the upper side is opened, the fine dust attached to the dust attachment plate is removed by being attached to an electrostatic brush. Further, the dust collecting part 80 is opened, and the dust accumulated on the lower side is removed by being drawn by a vacuum cleaner or the like.

The present disclosure provides the partition that may divide a space in the room without requiring a separate space in which a fine dust removing device such as an air cleaner or the like is installed. The present disclosure also provides the partition that may remove fine dust with low energy without using a precise filter such as a HEPA filter.

In addition, the present disclosure provides the partition that may remove fine dust by allowing air to circulate only by the stack effect without a forced ventilation means such as a fan.

In addition, the noise is perfectly absorbed while being continuously reflected and diffracted between the dust attachment plates in the partition, and as a result, it is possible to provide the partition that may block noise from the neighboring compartment and remove noise generated in the corresponding compartment without damaging an aesthetic appearance of the partition.

The present disclosure is not limited to the specific exemplary embodiment described above, various modifications can be made by any person skilled in the art to which the present disclosure pertains without departing from the subject matter of the present disclosure as claimed in the claims, and the modifications are within the scope defined by the claims.

What is claimed is:

1. A hybrid partition with a function of removing fine dust while dividing a space, the hybrid partition comprising:

a partition frame configured to support the hybrid partition on a floor;

outer finishing plates coupled to be opposite to each other and spaced apart from the partition frame at an interval;

dust attachment plates installed inside the outer finishing plates and configured to define an air flow space;

an air introduction part provided at a lower side of the hybrid partition and configured to communicate with the air flow space;

a dust collecting part provided in the air flow space, positioned at a position lower than the air introduction part and configured to collect the fine dust;

a dust removing part configured to remove the fine dust; and an air discharge part provided at an upper side of the hybrid partition, formed to communicate with the air flow space at the lower side of the hybrid partition, and configured to discharge air from which the fine dust is removed, wherein the air discharge part is positioned at a position higher than the air introduction part, the air containing the fine dust which is introduced from the air introduction part being discharged through the air discharge part, wherein the dust attachment plates include a negative-electrode dust attachment plate and a positive-electrode dust attachment plate which are made of metal materials having different potential differences and electrically bond with the fine dust being charged in the air, the negative-electrode dust attachment plate and the positive-electrode dust attachment plate being configured to attach the fine dust, wherein each of the dust attachment plates is provided with an anti-flow protrusion, and the anti-flow protrusion is formed in a direction perpendicular to a direction in which air flows in the air flow space, and the anti-flow protrusion protrudes inward toward the air flow space to hinder a flow of dust on a surface of each of the dust attachment plates to attach the fine dust.

2. The hybrid partition of claim 1, wherein the negative-electrode dust attachment plate is made of copper, and the positive-electrode dust attachment plate is made of one of iron, aluminum, and zinc having a different potential difference from copper.

3. The hybrid partition of claim 1, wherein the negative-electrode dust attachment plate and the positive-electrode dust attachment plate are connected to each other with a circuit, and the circuit includes a direct-current power supply device in order to increase the potential difference.

4. The hybrid partition of claim 1, further comprising:

an ion generating device provided in the air flow space and configured to emit positive ions and negative ions into the air flow space, wherein particles of the fine dust are charged by the emitted ions, the potential difference between the dust attachment plates and the particles of the fine dust is increased, and sizes of the particles of the fine dust are maximized as the particles of the fine dust bond with one another.

5. The hybrid partition of claim 1, wherein a sound absorber is provided between the outer finishing plates and the dust attachment plates, and inner sound absorbing holes are provided, at predetermined intervals, in the dust attachment plates.

6. The hybrid partition of claim 1, wherein outer sound absorbing holes are provided, at predetermined intervals, in the outer finishing plates.

* * * * *